US005564150A

United States Patent [19]

Ciccotelli

[11] Patent Number: 5,564,150

[45] Date of Patent: Oct. 15, 1996

[54] TOOTHBRUSH

[76] Inventor: Stephen S. Ciccotelli, P.O. Box 1414, Deming, N.M. 88031

[21] Appl. No.: 445,734

[22] Filed: May 22, 1995

[51] Int. Cl.[6] ..... A46B 9/04

[52] U.S. Cl. ..... 15/167.1; 15/143.1; 15/207.2

[58] Field of Search ..... 15/167.1, 167.2, 15/143.1, 207.2, DIG. 5, DIG. 6

[56] References Cited

U.S. PATENT DOCUMENTS

| | | | |
|---|---|---|---|
| 1,059,426 | 4/1913 | Barnes | 15/167.1 |
| 1,360,615 | 11/1920 | Bolard | 15/106 |
| 1,647,453 | 11/1927 | Krantz | 15/167.1 |
| 1,893,002 | 1/1933 | Rothschild | 15/143.1 |
| 1,928,328 | 9/1933 | Carpentier | 15/167.1 |
| 2,053,905 | 9/1936 | Fuller | 15/167.1 |
| 4,263,691 | 4/1981 | Pakarnseree | 15/207.2 |
| 4,519,109 | 5/1985 | Raymond | 15/167.1 |
| 4,646,381 | 3/1987 | Weihrauch | 15/167.1 |
| 4,800,608 | 1/1989 | Key | 15/167.1 |
| 5,146,645 | 9/1992 | Dirksing | 15/143.1 |

FOREIGN PATENT DOCUMENTS

| | | | |
|---|---|---|---|
| 818794 | 5/1952 | Germany | 15/167.1 |
| 2311043 | 9/1974 | Germany | 15/167.1 |
| 325367 | 3/1935 | Italy | 15/167.1 |
| 705725 | 3/1954 | United Kingdom | 15/167.1 |

*Primary Examiner*—David Scherbel
*Assistant Examiner*—Tony G. Soohoo
*Attorney, Agent, or Firm*—William J. Ruano

[57] ABSTRACT

A toothbrush is provided with a base and handle having a flexible neck portion in order to clear the lip and chin. A stepped neck portion is provided whereby the thickness of the flexible neck portion is substantially less than the thickness of the base, the length of the neck portion being substantially greater than the length of the base, the width of the entire neck portion is substantially less then the width of the base, and the entire thickness of the neck portion is less than the entire width of the neck portion. A stepped end face is provided at the end of the base and the surface of the base is disposed at an angle facing away from the handle front face.

12 Claims, 1 Drawing Sheet

TOOTHBRUSH

BACKGROUND OF THE INVENTION

Existing toothbrushes are designed for a brushing motion that sweeps the brush across the teeth. With this kind of brushing action, the area between teeth and the area of the tooth surface at the gum line do not receive adequate attention. Furthermore, this kind of brushing motion is hard on gums especially if the bristles are firm. For this reason many dentists recommend toothbrushes with soft bristles.

SUMMARY OF THE INVENTION

It is an object of this invention to provide a toothbrush that brushes better between teeth. It is another object of this invention to provide a toothbrush that brushes better at the gum line. It is a further object of this invention to provide a toothbrush that massages the gums at the gum line. Further objects and advantages will appear as the specification proceeds.

DESCRIPTION OF THE PREFERRED EMBODIMENT

Figure 2:
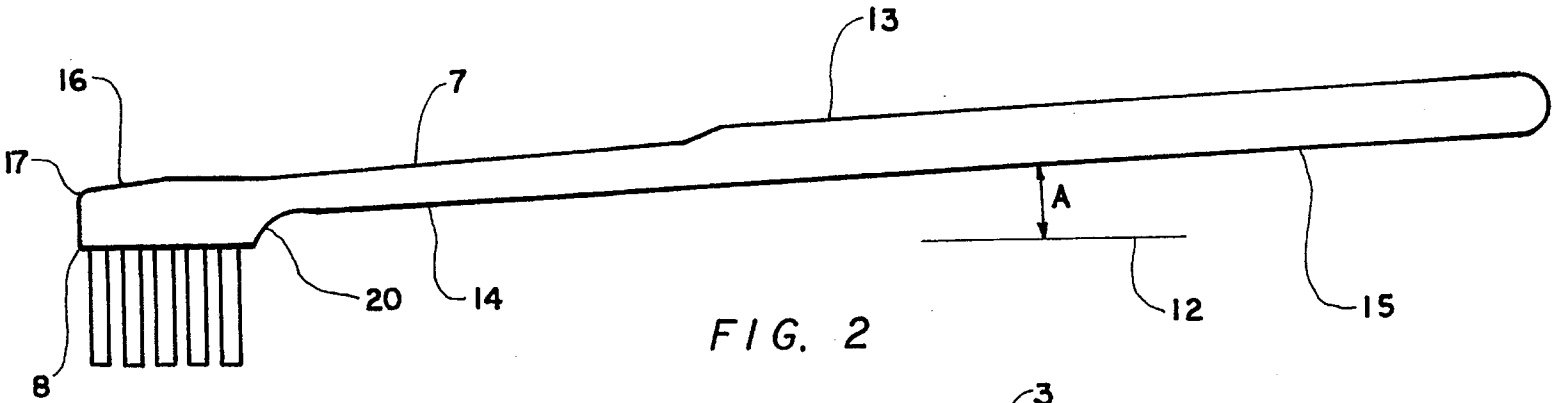
FIG. 2 is a side view of FIG. 1
Figure 1:
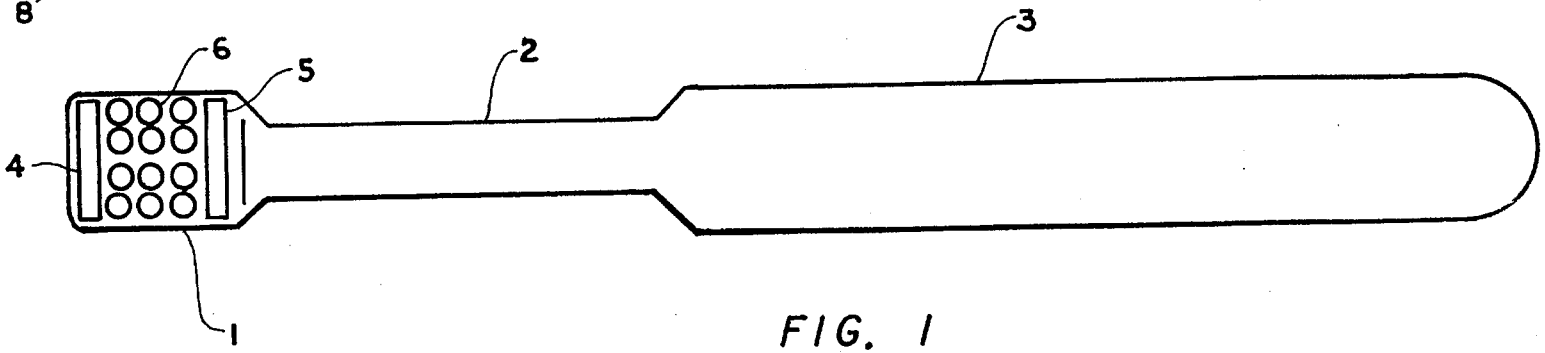
FIG. 1 is a front view of the toothbrush.
Figure 4:
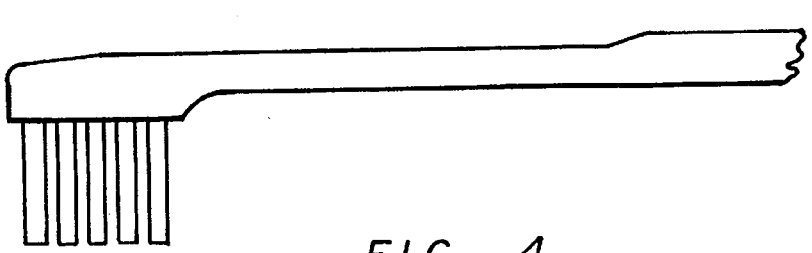
FIG. 4 is a partial side view of a toothbrush having a handle oriented generally parallel to the surface of the base to which the bristles are attached.

Referring to FIG. 1 and FIG. 2 of the drawings the toothbrush comprises a handle 13 and a brush head 17. The brush head 17 includes a base 1 having a surface 8 to which is attached a rectangular strip of bristles 4 located remote from the handle 13 and a rectangular strip of bristles 5 located near the handle 13, the rectangular strips of bristles 4 and 5 extending from one side of base 1 to the other side of base 1, the orientation of the rectangular strips of bristles 4 and 5 being formed by either individually standing bristles positioned closely together and welded to base i or by bristles being formed into tufts which are positioned closely together and staked to base 1, and at least one row of tufts 6 being attached to base 1 at a position located between rectangular strips 4 and 5.

The handle 13 is comprised of a neck portion 2 and a grip portion 3, the neck portion 2 forming the neck of the toothbrush and the grip portion 3 being adapted to be gripped by the user's fingers.

The length of neck portion 2 is substantially greater than the length of base 1.

The thickness of neck portion 2, measured anywhere along the entire length of neck portion 2 is substantially less than the thickness of base 1.

The distance across the width of neck portion 2, measured anywhere along the entire length of the neck portion 2 is substantially greater than the thickness of neck portion 2 but substantially less than the width of base 1.

The length, width and thickness of grip portion 3 of handle 13 is substantially greater than the length, width and thickness respectively of the neck portion 2.

Base 1 and handle 13 are molded in one piece. The advantages of a one piece molding are:

1. The profile of the brush head can be made lower.
2. There are no sharp corners.
3. There are no mating parts. Close fitting parts are conducive to the growth of harmful bacteria.
4. The toothbrush is easy to clean; and
5. The toothbrush can be manufactured at a lower cost.

Figure 3:
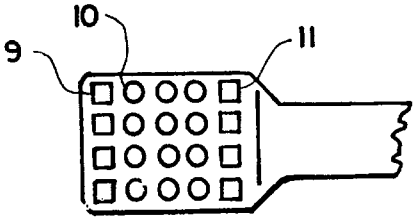
FIG. 3 is a partial front view of the toothbrush having an alternate tuft design.

FIG. 3 illustrates a toothbrush having tufts 9 of generally square configuration in the row remote from the handle 13 and tufts 11 having tufts of generally square configuration in the row near the handle 13. Between the rows of tufts having a square configuration are rows of tufts 10 having a generally circular configuration.

In order to achieve the objects of this invention it is necessary to brush the teeth using a different motion from that which is used with the conventional toothbrush. To brush the front surfaces of the front teeth using the toothbrush illustrated in FIGS. 1 and 2, the user holds the toothbrush in a vertical position and without raising his elbow makes up and down strokes over the surfaces of both the upper and lower front teeth, each upward stroke being terminated when the rectangular strip of bristles 4 bears lightly against the edge of the gum of the upper teeth and each downward stroke being terminated when the rectangular strip of bristles 5 bears lightly against the edge of the gum of the lower teeth.

This kind of motion enables the toothbrush to clean between the teeth, to clean at the gum line and to massage the edge of the gum at the gum line. Brushing the teeth using up and down strokes while keeping the elbow down has the added advantage of utilizing strong muscles of the arm, thereby enabling the user to accurately control the movement of the toothbrush.

After all the surfaces of the front teeth have been cleaned, the user brushes the outer surfaces of the back teeth. When brushing a back tooth, while making up and down strokes, the user rolls the toothbrush handle between his fingers, thereby conveniently cleaning all around the back tooth. The inner surfaces of the upper teeth are cleaned by using up and down strokes. Since in the toothbrush of FIG. 1 and FIG. 2 and FIG. 3 and FIG. 4, the row of bristles remote from the handle 13 and the row of bristles near the handle 13 briefly contact the edge of the gum during each brushing cycle, special consideration is given to tuft design and bristle arrangement to prevent injury to the gums.

If the toothbrush has rectangular strips of bristles 4 and 5 as illustrated in FIG. 1 and FIG. 2, it is essential that the rectangular strips of bristles 4 and 5 be:

1. Generally straight;
2. Generally perpendicular to handle 13; and
3. Comprised of bristles having generally the same height.

If the toothbrush has tufts of square configuration in the row remote from the handle 13 and tufts of square configuration near handle 13 as illustrated in FIG. 3, it is essential that each row of tufts be:

1. Generally straight;
2. Generally perpendicular to handle 13;
3. Comprised of bristles having generally the same height; and
4. Comprised of at least three tufts.

Some conventional toothbrushes have staggered rows of tufts, or have tufts of unequal height, or have tapered rows of tufts, or may have rows of tufts with less than three tufts per row; any of these features will injure the edge of the gum if included in the design of the toothbrush of the present invention.

Tufts having a generally circular configuration may also be used in the toothbrush of the present invention providing that the tufts meet the design requirements of tufts having a square configuration. But tufts having a square configuration are preferred inasmuch as the user feels less discomfort and there is less possibility of injury to the gum when the square tufts contact the edge of the gum.

When brushing an upper back tooth in the fashion described in this specification, all of brush head 17 and neck portion 2 enter the mouth; therefore, it is essential that:

1. Brush head 17—neck portion 2 part of the toothbrush have a low profile;

2. Neck portion 2 take up as little space in the mouth as possible;

3. Both brush head 17 and neck portion 2 have no sharp corners; and that 4. The plane of the rear face 16 of base 1 be generally aligned with the plane of rear face 7 of neck portion 2.

When brushing the front faces of the front teeth in the manner described in this specification, it is essential that the neck portion 2 clear the lip and chin.

In order to provide clearance space for the lip and chin without substantially increasing the height of the brush head 17—neck portion 2 part of the toothbrush:

1. The thickness of neck portion 2 is substantially less than the thickness of base 1 and in order to provide sufficient strength for supporting the brush head 17 during brushing, the distance measured across the entire width of neck portion 2 is substantially greater than the thickness of neck portion 2;

2. The neck portion 2 is molded to the rear end face 20 of base 1 at a position in which the entire front face 14 of neck portion 2 clears plane 12 of surface 8 of base 1 to which the bristles are attached thereby forming a distinct step between surface 8 of base 1 and front face 14 of the neck portion 2, the rear face 16 of the base 1 making a smooth transition with the rear face 7 of neck portion 2;

3. Front face 14 of neck portion 2 is angled slightly away from the plane 12 of surface 8 of base 1 to which the bristles are attached; and 4. Front face 15 of grip portion 3 of handle 13 is generally aligned with front face 14 of neck portion 2.

In order to provide a neck portion 2 that takes up as little space as possible in the mouth, the sides of the neck portion 2 are preferably made generally parallel, the length of the neck portion 2 is made substantially longer than the length of base 1 and the width of the neck portion 2 is made substantially less than the width of the base 1.

During the early stages of development of the present invention, it was found that brushing the teeth in the manner described in this specification resulted in the toothbrush having an undesirable short effective life owing to the bristles located remote from the handle becoming permanently bent or distorted, and that the uneven wear of the bristles was caused by the fact that the lip and chin of the user prevented the brush head from assuming an angle that permitted all of the bristles to contact the teeth evenly.

Providing clearance space for the lip and chin as described in this specification for the preferred form of my invention, which is illustrated in FIG. 1 and FIG. 2, greatly improved the effective life of the toothbrush.

Another means for increasing the effective life of the toothbrush of the present invention is to provide a neck portion 2 which is partly flexible. This is easily accomplished by sizing the thickness of neck portion 2 to the required thickness for attaining the desired degree of flexibility. The thickness of neck portion 2, in proportion to the rest of the toothbrush, that provides the degree of flexibility needed is illustrated in FIG. 2.

Some conventional toothbrushes have a handle in which a flexible section is located some distance away from the brush head, but if a flexible section in the handle of the toothbrush of the present invention is to be effective it is essential that the section be partly flexible and that it be located near the brush head.

In FIG. 2 the handle 13 is shown molded to the base 1 at an angle A which is approximately 3° with respect to plane 12 of surface 8 to which the bristles are attached; however, during usage, since the neck portion 2 is partly flexible, angle A increases by an amount depending upon the degree of force applied to the handle by the user to press the brush head against the teeth.

Providing the toothbrush illustrated in FIG. 2 with a partly flexible neck portion 2 and angling the handle 13 with respect to the plane 12 of surface 8 to which the bristles are attached increases the effective life of the toothbrush by four times.

While I have illustrated the preferred embodiment of my invention, it will be understood that this is by way of illustration only and various changes are contemplated in my invention within the scope of the following claims:

I claim:

1. A toothbrush comprising:

(A) a base having a flat rear face, a rear end face, a flat base surface, a thickness, a width, and a length, (B) a straight handle; the handle and the base being molded into one piece, the handle being comprised of a straight, flat neck portion and a flat grip portion, the neck portion having a flat front face, a flat rear face, a width, a thickness and a length, and the grip portion having a flat front face;

whereby, the length of the entire neck portion is substantially greater than the length of the base; the thickness of the entire neck portion is substantially less that the thickness of the base; the width of the entire neck portion is substantially less then the width of the base, and; the entire thickness of the neck portion is less than the entire width of the neck portion;

(C) a row of bristles attached to the base at a position remote from the handle;

(D) a row of bristles attached to the base at a position near the handle;

(E) at least one row of bristles attached to the base at a position located between the base at a position located between the row of bristles remote from the handle and the row of bristles near the handle;

the neck portion of the handle being molded to the rear end face of the base at a position in which the entire front face of the neck portion lies parallel to the plane of the surface of the base to which the bristles are attached thereby forming a distinct step between the surface of the base to which the bristles are attached and the front face of the neck portion of the handle, and the rear face of the base making a smooth transition between the rear face of the neck portion of the handle.

2. In the toothbrush of claim 1 wherein remote from the handle the bristles are positioned closely together and arranged in a generally straight rectangular strip, and near the handle the bristles are positioned closely together and arranged in a generally straight rectangular strip, the orientation of both rectangular shaped strips being generally perpendicular to the handle.

3. In the toothbrush of claim 2 wherein the bristles in both rectangular strips are generally of the same length.

4. In the toothbrush of claim 1 wherein the bristles remote from the handle are formed into tufts having a generally square shape configuration and arranged in a generally straight row and near the handle the bristles are formed into tufts having a generally square shaped configuration and arranged in a generally straight row, the orientation of both rows of square tufts being generally perpendicular to the handle.

5. In the toothbrush of claim 1 wherein the of the front face of the grip portion of the handle is co-planar with the front face of the neck portion of the handle.

6. In the toothbrush of claim 1 wherein the length, width and thickness of the grip portion of the handle is greater than the length, width and thickness respectively of the neck portion of the handle.

7. In the toothbrush of claim 1 wherein the orientation the front face of the neck portion of the handle is in a direction which is angled slightly away from the plane of the surface of the base to which the bristles are attached.

8. In the toothbrush of claim 7 wherein the neck portion of the handle is partly flexible.

9. In the toothbrush of claim 1 wherein the plane of the rear face of the base is co-planar with the plane of the rear face of the neck portion of the handle.

10. In the toothbrush of claim 1 wherein the bristles remote from the handle are formed into tufts having a generally circular shaped configuration and arranged in a generally straight row which is generally perpendicular to the handle, the row having a minimum of three tufts and wherein the bristles near the handle are formed into tufts having a generally circular shaped configuration and arranged in a generally straight row which is generally perpendicular to the handle, the row having a minimum of three tufts.

11. A tooth brush comprising:

(A) a base; the base having a flat rear face, a rear end face, a thickness, a width and a length, (B) a plurality of bristles attached to the base;

(C) a handle;

the handle and the base being molded in one piece, the handle having a straight, flat, flexible neck portion and a grip portion, the flexible neck portion having a flat rear face and a flat front face whereby, the thickness of the flexible neck portion is substantially less than the thickness of the base; the length of the neck portion being substantially greater than the length of the base;

and the flexible neck portion being molded to the rear end face of the base at a position which the rear face of the base and the rear face of the neck portion are co-planar and;

the orientation of the front face of the neck portion is in a direction which is angled away from the plane of the surface to which the bristles are attached.

12. In the toothbrush of claim 11 wherein the plane of the partly flexible portion and the plane of the grip portion are generally aligned and the orientation of the handle is in a direction in which the plane of the handle is angled away from the plane of the base.

* * * * *